US007063051B2

(12) United States Patent
Schellhase

(10) Patent No.: US 7,063,051 B2
(45) Date of Patent: Jun. 20, 2006

(54) LIQUID-COOLED VALVE SEAT RING

(75) Inventor: Torston Schellhase, Vaihingen/Enz (DE)

(73) Assignee: Mahle Ventiltrieb GmbH, Stuttgart (DE)

( * ) Notice: Subject to any disclaimer, the term of this patent is extended or adjusted under 35 U.S.C. 154(b) by 123 days.

(21) Appl. No.: 10/477,300

(22) PCT Filed: May 7, 2002

(86) PCT No.: PCT/EP02/04997

§ 371 (c)(1),
(2), (4) Date: Nov. 10, 2003

(87) PCT Pub. No.: WO02/097245

PCT Pub. Date: Dec. 5, 2002

(65) Prior Publication Data

US 2004/0182332 A1 Sep. 23, 2004

(30) Foreign Application Priority Data

May 10, 2001 (DE) ..... 101 22 581

(51) Int. Cl.
*F01P 1/06* (2006.01)

(52) U.S. Cl. ..... 123/41.85; 123/188.9

(58) Field of Classification Search ..... 123/188.8, 123/188.9, 41.85

See application file for complete search history.

(56) References Cited

U.S. PATENT DOCUMENTS

| | | | |
|---|---|---|---|
| 3,822,680 | A | 7/1974 | Showalter et al. |
| 4,147,149 | A | 4/1979 | Andrea |
| 4,522,161 | A | 6/1985 | Slee |
| 4,941,436 | A | 7/1990 | Beer et al. |

FOREIGN PATENT DOCUMENTS

| | | |
|---|---|---|
| DE | 865405 | 7/1949 |
| DE | 2401315 | 11/1974 |
| DE | 287078 | 10/1983 |
| DE | 3829339 | 12/1989 |
| DE | 3937402 | 5/1991 |
| DE | 4328904 | 4/1994 |
| DE | 4301632 | 7/1994 |
| DE | 19813430 | 11/1998 |
| FR | 1476008 | 4/1967 |
| GB | 152313 | 11/1921 |
| GB | 668962 | 3/1952 |
| GB | 844119 | 9/1960 |

*Primary Examiner*—Noah P. Kamen
(74) *Attorney, Agent, or Firm*—Collard & Roe, P.C.

(57) ABSTRACT

A cooled valve seat ring for a cylinder head of an internal combustion engine, having a valve seat part, wherein the cooled valve seat ring comprises a sheet-metal cooling channel consisting of a thin sheet of steel and which is connected with a coolant circuit via bores which serve as inflow and outflow for a coolant, wherein the cooled valve seat ring is connected with the cylinder head material by casting technology. In one embodiment, there can be a cooled valve seat ring that is connected with a cylinder head material via a laminate casting process. There can also be a cooled valve seat ring that has an alfin layer for a connection with the cylinder head material. In addition, the cooling channel can be welded onto or soldered onto the valve seat part. Furthermore, the sheet-metal cooling channel can be connected with the valve seat part so as to form a gas-tight seal.

13 Claims, 2 Drawing Sheets

LIQUID-COOLED VALVE SEAT RING

CROSS REFERENCE TO RELATED APPLICATIONS

Applicant claims priority under 35 U.S.C. §119 of German Application No. 101 22 581.4 filed on May 10, 2001. Applicant also claims priority under 35 U.S.C. §365 of PCT/EP02/04997 filed on May 7, 2002. The international application under PCT article 21(2) was not published in English.

BACKGROUND OF THE INVENTION

The invention relates to a cooled valve seat ring.

In the sector of outlet valves of internal combustion engines, an attempt is made to bring the cooling water mantle as close as possible to the valve seat rings. This design is to achieve a good removal of heat. In the current multi-valve cylinder heads of engines with direct diesel injection and a centrally arranged injection nozzle, the tight space conditions often do not permit any satisfactory presentation of the cooling water mantle. The outlet valve ridge region, in particular, and the ridge between the outlet channels and the injection nozzle must then be implemented in such a finite manner that it is nearly impossible to introduce a water mantle core that can be used in series production.

Therefore, valve seat rings having their own cooling channel were already proposed, whereby the cooling channel is configured to be either open or closed towards the cylinder head.

Such valve seat rings are known from DE 3829339, DD 287078, or DE 4328904. In this connection, a cooling channel that is closed towards the cylinder head is provided in the valve seat ring, in each instance, in the publications mentioned first. According to DE 3829339, the cooling channel consists of two solid components that are welded together, into which the valve seat part is pressed. The cooled valve seat ring is cast into the cylinder head. The production of the cooled valve seat ring from solid components is complicated and results in a relatively high weight disadvantage, and in internal stresses because the valve seat parts are pressed into the cooling channel part.

The invention therefore concerns itself with the problem of creating a cooling channel in valve seat rings of this type, which is easy to produce and is light.

SUMMARY OF THE INVENTION

This problem is solved by means of a cooled valve seat ring. In the solution according to the invention, the cooling channel, which comprises a thin sheet of steel, and is open on one side, is directly welded to the valve seat part. Essentially the invention relates to a cooled valve seat ring for a cylinder head of an internal combustion engine, having a valve seat part, wherein the cooled valve seat ring comprises a sheet-metal cooling channel consisting of a thin sheet of steel and which is connected with a coolant circuit via bores which serve as inflow and outflow for a coolant, wherein the cooled valve seat ring is connected with the cylinder head material by casting technology.

Weight can clearly be saved with the sheet-metal cooling channel made of a thin sheet of steel, as compared with the production from solid material. Preferably, the sheet-metal cooling channel is produced by means of bending, if necessary also by deep-drawing of a flat piece of sheet metal. Another advantage of the sheet-metal cooling channels, as compared with the known cooled valve seat rings, is the fact that independent of the cross-section of the valve seat part, a freely selectable channel cross-section can be set.

The thickness of the thin sheet of steel is preferably less than 1.2 mm, and advantageously lies between 0.3 and 0.7 mm.

BRIEF DESCRIPTION OF THE DRAWINGS

The invention will be explained in greater detail in the following, using an exemplary embodiment. The drawing shows.

DETAILED DESCRIPTION

Figure 1:
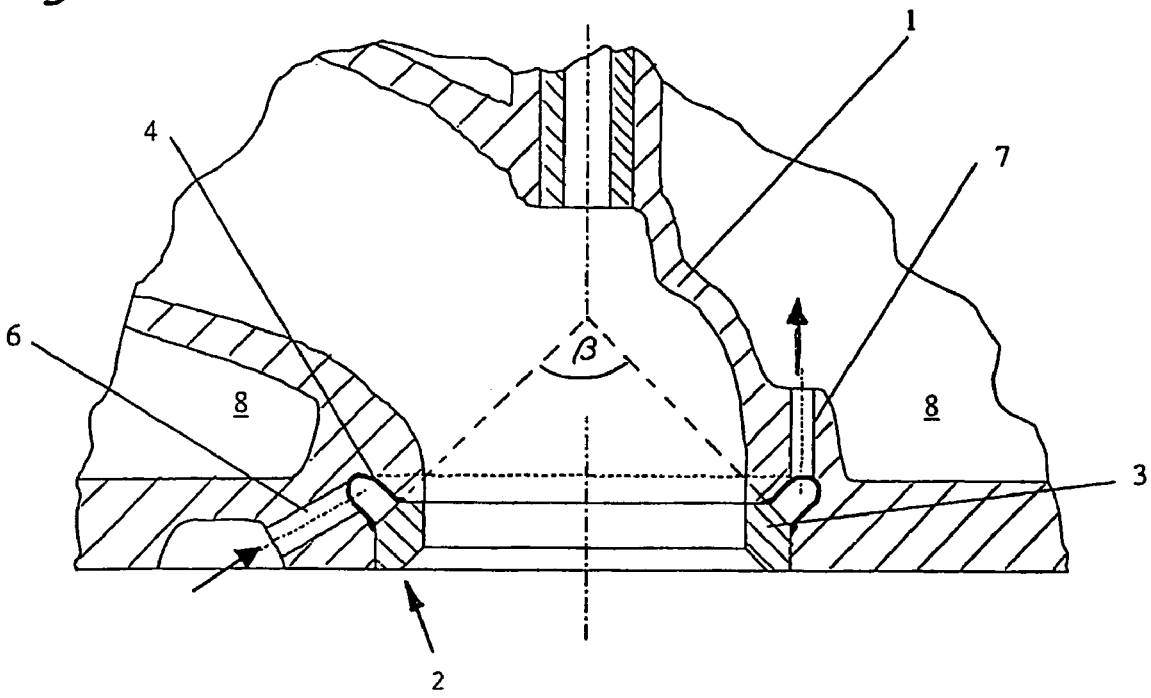
FIG. 1 a cylinder head having a cooled valve seat ring according to the invention, FIG. 2 a valve seat ring having a centering collar.

Referring in detail to the drawings, FIG. 1 shows a cooled valve seat ring 2, consisting of a valve seat part 3 and a sheet-metal cooling channel 4 welded onto the valve seat part, is connected with a cylinder head 1 by means of a laminate casting process.

The ring space 5 formed by the sheet-metal cooling channel is connected with a coolant circuit by way of bores 6 and 7.

The valve seat part 3 has a bevel that is characterized by a cone angle beta. The sheet-meal cooling channel 4 covers the valve seat part 3 in the region of this bevel.

Figure 2:
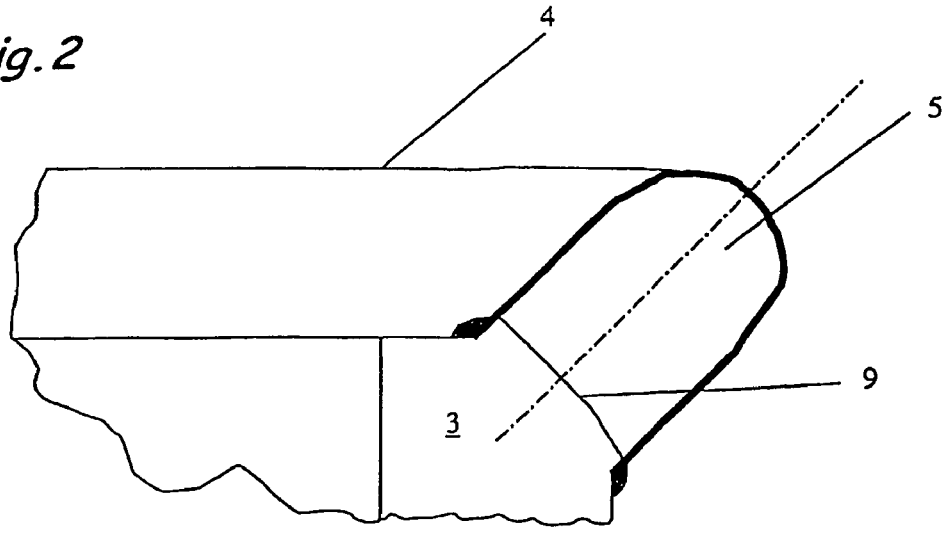

According to FIG. 2, the valve seat part 3 has centering projections 9 that fix the sheet-metal cooling channel 4 in place on the valve seat part 3 during the welding process.

Figure 3:
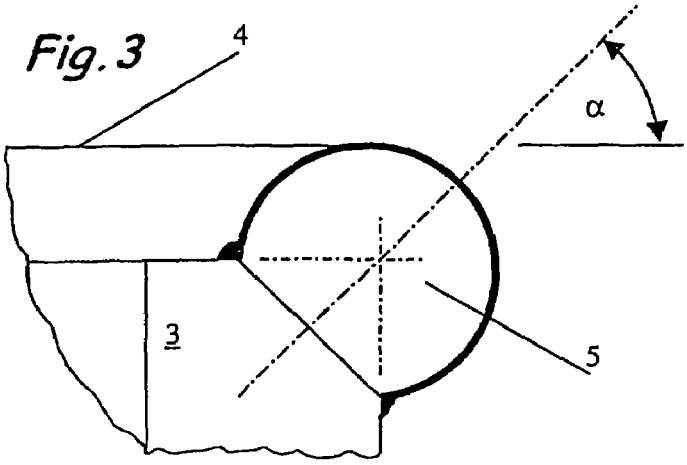
FIG. 3 shows one other variant of the invention.

FIG. 3 shows a cut-out of a valve seat ring having a cooling channel welded on, in cross-section, which is configured as a pipe-shaped component having an open side that faces the seat ring, whereby the sheet-metal channel is joined to the valve seat ring with its two free shanks so as to form a gas-tight seal. The seat ring has a bevel at an angle of alpha=45°, so that the free cross-sectional surface for the coolant flow is as great as possible. The bevel delimits the coolant channel on the seat ring side.

Figure 4:
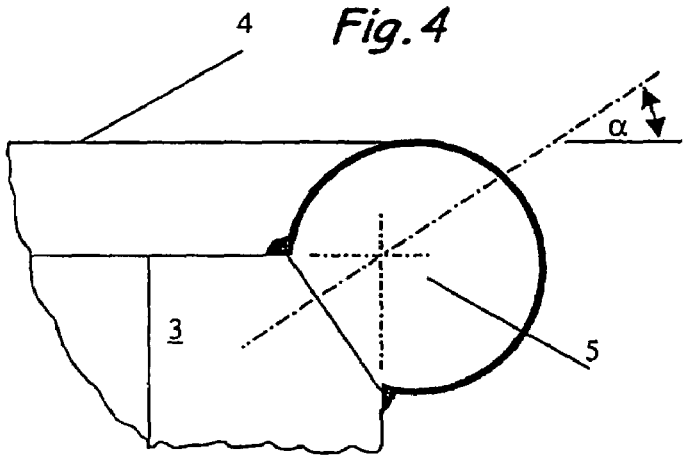
FIG. 4 shows another variant of the invention.

FIG. 4 shows a similar valve seat ring having an angle alpha <45°, corresponding to a cone angle beta of <90°.

The cone angle formed by the bevel that runs around the circumference of the valve seat ring, i.e. the cone angle beta, will lie between 70° and 110°, in most cases.

The selection of the cone angle depends on the general geometric conditions, particularly on the minimum wall thickness values that must be maintained.

Figure 5:
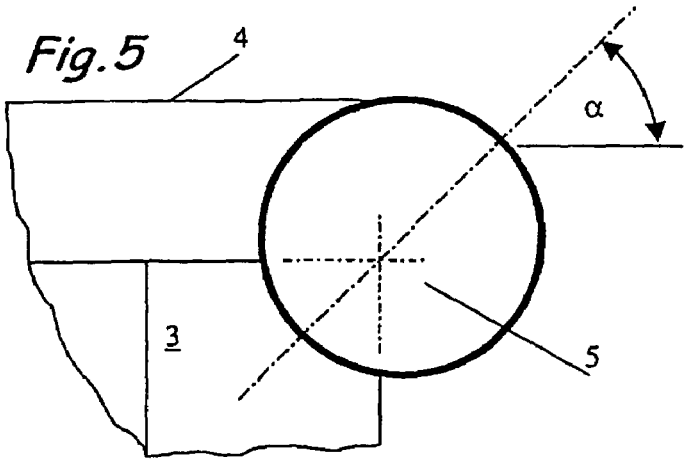
FIG. 5 shows another variant of the invention.

According to FIG. 5, the sheet-metal cooling channel is configured in closed, pipe shape, with a circular cross-section, and the seat ring has a recess adapted to the cooling channel diameter, into which the sheet-metal cooling channel is placed. In comparison with the exemplary embodiments presented above, at least one weld seam can be eliminated in this way.

It is advantageous if the welding process takes place in a partial vacuum, in order not to make the welding process for closing the seam more difficult due to escaping air.

Accordingly, while at least one embodiment of the present invention have been shown and described, it is to be understood that many changes and modifications may be made thereunto without departing from the spirit and scope of the invention as defined in the appended claims.

The invention claimed is:

1. A cooled valve seat ring for a cylinder head of an internal combustion engine, having a valve seat part, the cooled valve seat ring comprising: a sheet-metal cooling channel consisting of a thin sheet of steel and connected with a coolant circuit via bores which serve as inflow and outflow for a coolant, wherein the cooled valve seat ring is connected with the cylinder head material by means of casting technology.

2. A cooled valve seat ring according to claim 1, wherein the cooled valve seat ring is connected with the cylinder head material by means of a laminate casting process.

3. The cooled valve seat ring according to claim 1, wherein the cooled valve seat ring has an alfin layer for a connection with the cylinder head material.

4. The cooled valve seat ring according to claim 1, wherein the sheet-metal cooling channel is welded onto or soldered onto the valve seat part.

5. The cooled valve seat ring according to claim 1, wherein the sheet-metal cooling channel is connected with the valve seat part so as to form a gas-tight seal.

6. The cooled valve seat ring according to claim 1, wherein the valve seat part is a sintered part infiltrated with copper, and that the connection between the sheet-metal cooling channel and the valve seat part is produced by means of infiltration of the valve seat part with copper, while simultaneously wetting the sheet-metal cooling channel.

7. The cooled valve seat ring (2) according to claim 1, wherein the sheet-metal cooling channel is shaped in U shape and faces the valve seat part with its open side.

8. The cooled valve seat ring according to claim 1, wherein the valve seat part has projections, with which the sheet-metal cooling channel is centered on the valve seat part, so that no additional clamping devices are necessary during welding or soldering.

9. The cooled valve seat ring according to claim 8, wherein the cone angle beta formed by the bevel on the valve seat ring lies between 70° and 110°.

10. The cooled valve seat ring according to claim 1, wherein the valve seat part is beveled on its surfaces that face towards the sheet-metal cooling channel.

11. The cooled valve seat ring according to claim 1, wherein the sheet-metal cooling channel is configured as a pipe-shaped or torus-shaped, closed component, and that the valve seat part has a recess that runs around the circumference, is arc-shaped in cross-section, and is fitted to the sheet-metal cooling channel, into which the sheet-metal cooling channel is placed.

12. The cooled valve seat ring according to claim 11, wherein the sheet-metal cooling channel is connected with the valve seat part by means of a resistance pressing process or by means of soldering.

13. The cooled valve seat ring according to claim 1, wherein the sheet-metal cooling channel is arc-shaped in cross-section, with a segment angle of up to 300°, and that the valve seat part is beveled on its surface that faces towards the circumferential opening of the sheet-metal cooling channel.

* * * * *